US005487396A

United States Patent [19]

Wilson

[11] Patent Number: 5,487,396

[45] Date of Patent: Jan. 30, 1996

[54] PERMANENT ROD KIT AND METHOD

[76] Inventor: Samantha L. Wilson, 6824 114th Pl., Unit D, Miami, Fla. 33173

[21] Appl. No.: 180,438

[22] Filed: Jan. 12, 1994

[51] Int. Cl.[6] ..... A45D 2/14

[52] U.S. Cl. ..... 132/248; 132/210; 132/226; 132/237

[58] Field of Search ..... 132/210, 211, 132/245, 248, 251, 250, 261

[56] References Cited

U.S. PATENT DOCUMENTS

| | | | |
|---|---|---|---|
| 2,892,460 | 6/1959 | LeClabart | 132/245 |
| 3,050,069 | 8/1962 | Brown . | |
| 3,363,634 | 1/1968 | LeClabart | 132/210 |
| 3,530,863 | 9/1970 | Foster | 132/248 |
| 4,108,183 | 8/1978 | Mauro | 132/250 |
| 5,042,513 | 8/1991 | Ferguson | 132/247 |
| 5,193,558 | 3/1993 | Squatrito | 132/250 |

*Primary Examiner*—John G. Weiss
*Attorney, Agent, or Firm*—Jack E. Dominik

[57] ABSTRACT

A perm rod kit in which the perm rod has a tight wrap section and a loose wrap section of differing diameters, and in which the transition between the two is accomplished at a mid-portion of the rod kit is disclosed. In addition, a band is provided which is secured to a band cap and then transitioned to the opposite end of the perm rod for utilizing with a band plug to thereby secure a band across the entire strand of the hair after it has been wrapped on the perm rod. The method of the present invention is directed primarily to apply a permanent to any length of hair with the resulting look of naturally curly hair, irrespective of whether the root portion has grown out straight and virgin, and the balance of the strand portion has a residual curl from a pre-existing permanent wave. In accordance with the method the strands of hair are normally first wetted, and then thereafter wrapped around the two step rod with the small end approaching the scalp as close as comfort will permit. Once the entire strand has been wrapped and secured in place with the band, and the entire head has been so treated, a solution is applied which causes the hair in its wrapped configuration to change and therefore accept the curl which has been induced by the perm rod kit. After curling has taken place for a period of time of five to twenty-five minutes, depending upon the observation of the beautician, the hair is then neutralized and after neutralized for at least five minutes, the perm rod kit is removed.

8 Claims, 3 Drawing Sheets

PERMANENT ROD KIT AND METHOD

FIELD OF THE INVENTION

The present invention relates to a permanent rod kit for the permanent waving of hair and a method of using the permanent rod kit which can transition for virgin hair to older hair which has been the subject of a permanent wave, or which can take the virgin hair from the scalp to the end, or which can be used to upgrade a pre-existing permanent wave by addressing the root area which can also be used on chemically processed, color treated hair, as to which the ends will always take tighter than the root area during the permanent waving process.

BACKGROUND OF THE INVENTION

Curling hair, particularly on females, has been with us for as many years as anyone can remember. The most basic technique for curling hair can be just wrapping it around a curler, and leaving it around a cutler for a period of time to conform to the curved portion of the curler. Other techniques, such as the hot curling rod, do not use solutions generally but wrap the strand of hair around a hot rod which causes a change in the cross-section of the hair itself. Straight hair is normally perfectly circular. Kinky or tightly curly hair normally has an elliptical cross-section. Sometimes it is desired to take the curly hair which is too tight a curl, and loosen it. The normal case, however, is to take a straight or partially straight strand of hair and introduce a curl to it. More recently, cold wave and hot wave techniques have been employed. In most instances, a chemical is involved. The chemical used is primarily present to permit a softening of the hair, to a degree attacking the surface, and rendering the change in cross-section from circular to elliptical more easily achieved. The present invention is directed to that area of utilizing a chemical but in which the beautician is afforded the flexibility of applying a single strand of hair to a perm rod kit which permits access to the strand at almost the scalp of the patron, and yet treating a full strand of the hair from the scalp to its very end.

SUMMARY OF THE INVENTION

The present invention is directed to a perm rod kit in which the perm rod has a tight wrap section and a loose wrap section of differing diameters, and in which the transition between the two is accomplished at a mid-portion of the rod kit. In addition, a band is provided which is secured to a band cap and then transitioned to the opposite end of the perm rod for utilizing with a band plug to thereby secure a band across the entire strand of the hair after it has been wrapped on the perm rod. The method of the present invention is directed primarily to apply a permanent to any length of hair with the resulting look of naturally curly hair, irrespective of whether the root portion has grown out straight and virgin, and the balance of the strand portion has a residual curl from a pre-existing permanent wave unless otherwise a unique and customized look is desired, e.g. root perm; curl at root area only. In accordance with the method the strands of hair are normally first wetted, and then thereafter wrapped around the two step rod with the small end approaching the scalp as close as comfort will permit. Once the entire strand has been wrapped and secured in place with the band, and the entire head has been so treated, a solution is applied which causes the hair in its wrapped configuration to change and therefore accept the curl which has been induced by the perm rod kit.

After curling has taken place for a period of time of five to twenty-five minutes, depending upon the observation of the beautician, the hair is then neutralized and after neutralized for at least five minutes, the perm rod kit is removed.

In view of the foregoing it is a principal object of the present invention to provide a perm rod kit which is adaptable to a wide variety of hair conditions, including the natural as well as the treated hair condition which is pre-existing when the beautician works on the head.

Another and important object of the present invention is to provide a perm rod which will address the full length of a strand of hair and yet is sufficiently lightweight that it will not cause undue discomfort when applied even close to the scalp.

An additional advantage to the present invention is that the perm rod kit is relatively inexpensive to manufacture, it can be molded from an inert plastic material which will not damage the hair, and it is forgiving for the temperature extremes that may be involved in the process including drying if it is to remain in the hair during part of the drying process.

BRIEF DESCRIPTION OF THE ILLUSTRATIVE DRAWINGS

Further objects and advantages of the present invention will become apparent as the following description of an illustrative embodiment proceeds, taken in conjunction with the accompanying drawings, in which.

DESCRIPTION OF A PREFERRED EMBODIMENT

Figure 1:
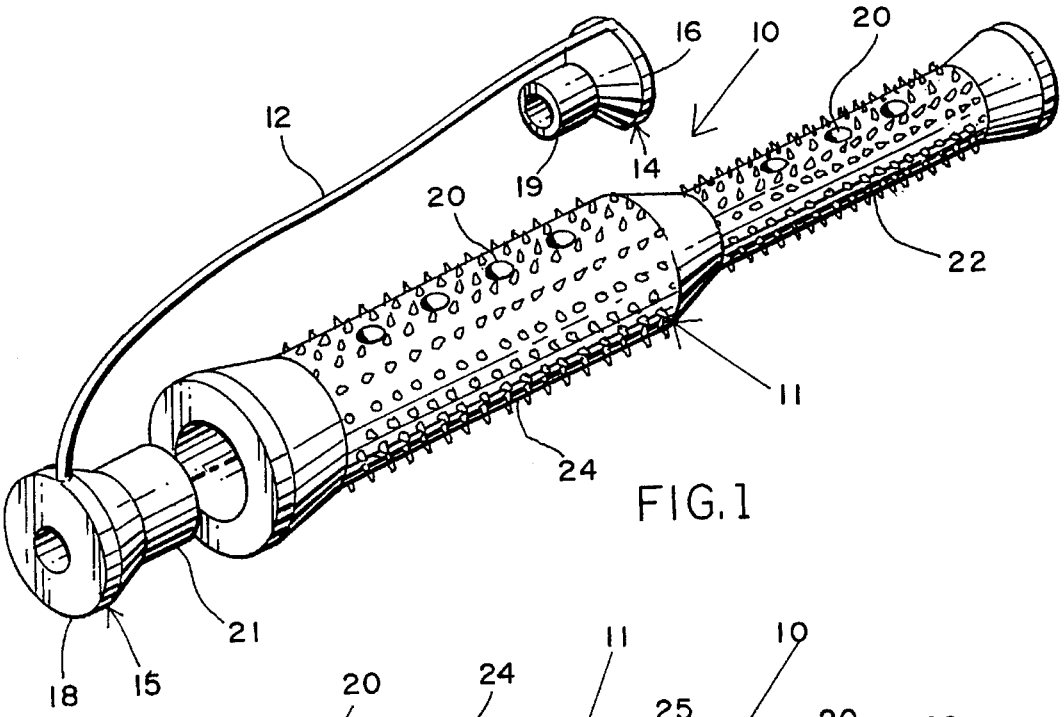
FIG. 1 is a partially exploded perspective view of a permanent rod kit showing the basic elements of the unit.
Figure 2:
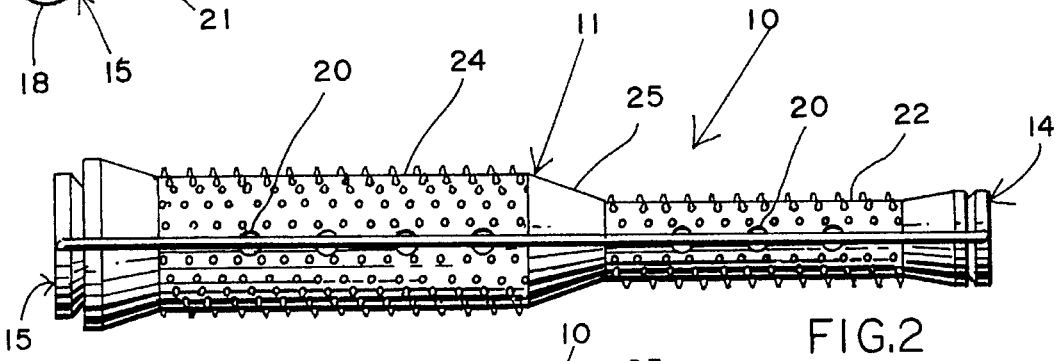
FIG. 2 is a top view of the subject permanent rod kit.
Figure 3:
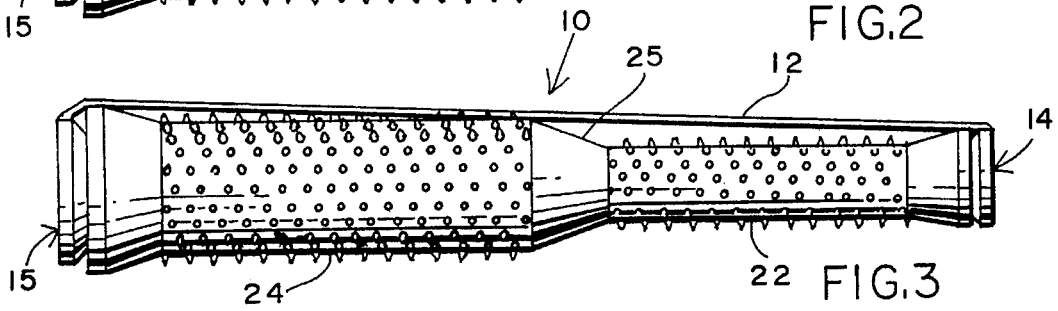
FIG. 3 is a front elevation of the permanent rod kit.
Figure 4:
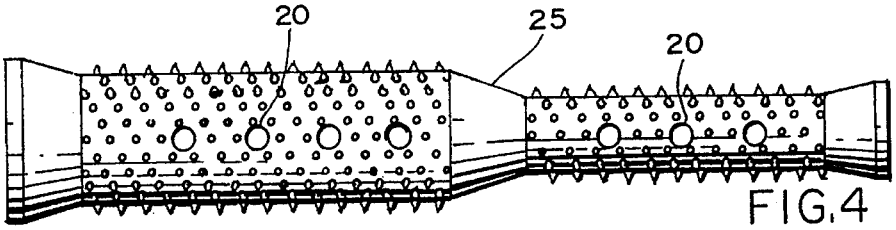
FIG. 4 shows the permanent rod kit with the ends and the band removed.
Figure 5:
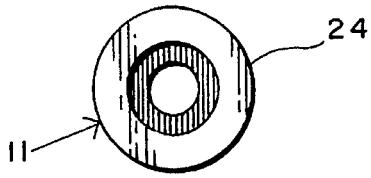
FIG. 5 is an end view of the larger end of the perm rod kit adjacent the loose wrap section.
Figure 6:
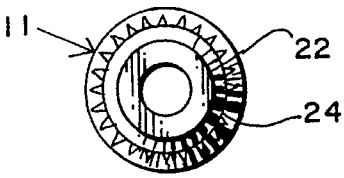
FIG. 6 is an end view of the perm rod kit adjacent the tight wrap portion.

Turning now to FIG. 1, it will be seen that the permanent rod kit 10 includes a center body portion or permanent rod 11, and an elastomeric band 12. The band is removably secured through a recessed means to a band cap 14, and a band plug 15 which are inserted respectively in the ends of the perm rod 11. A collar 16 is on the band cap 14 and an additional collar 18 is on the band plug 15. Each of the plug and collar has a male section 19, 21 which is inserted interiorly of the perm rod 11 at the respective ends. Drains 20 are provided along the body portion of the perm rod 11 to permit water or permanent wave solution to drain interiorly of the strand and be removed from the hair so that unwanted concentrations of the solution do not remain on the perm rod 11.

To be noted are two different diameter sections of the perm rod 11, namely, the tight wrap section 22 and the loose wrap section 24. These are desirably 0.55 inches for the tight wrap section 22, and 0.75 inches for the loose wrap 24. A wrap divider which is tapered is provided between the two sections, and is identified as wrap divider 25 also varied lengths to this invention.

Figure 7:
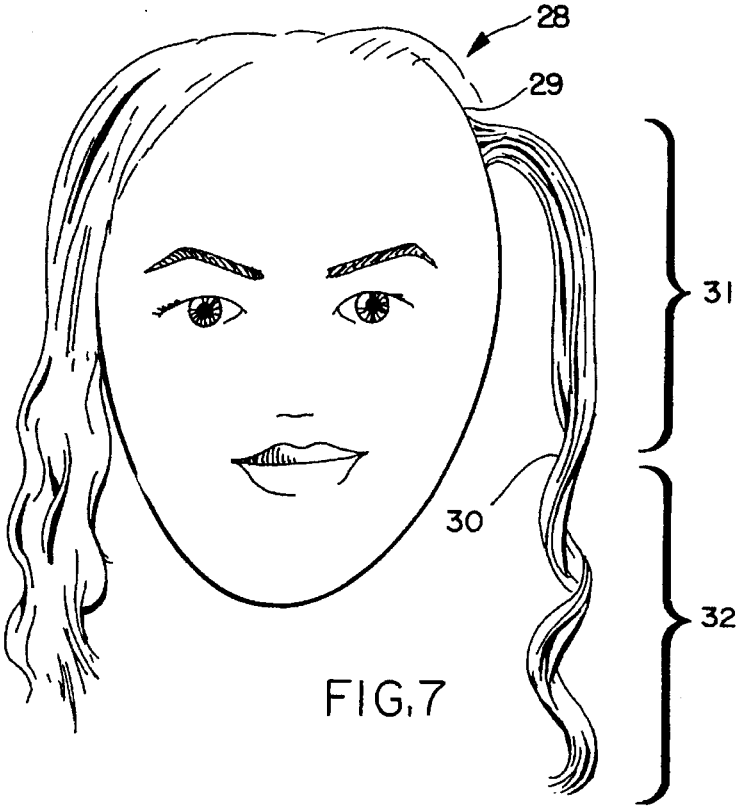
FIG. 7 is a partially diagrammatic view of a head showing the hair as it grows out from the scalp and identifying new straight hair old permanent hair.
Figure 8:
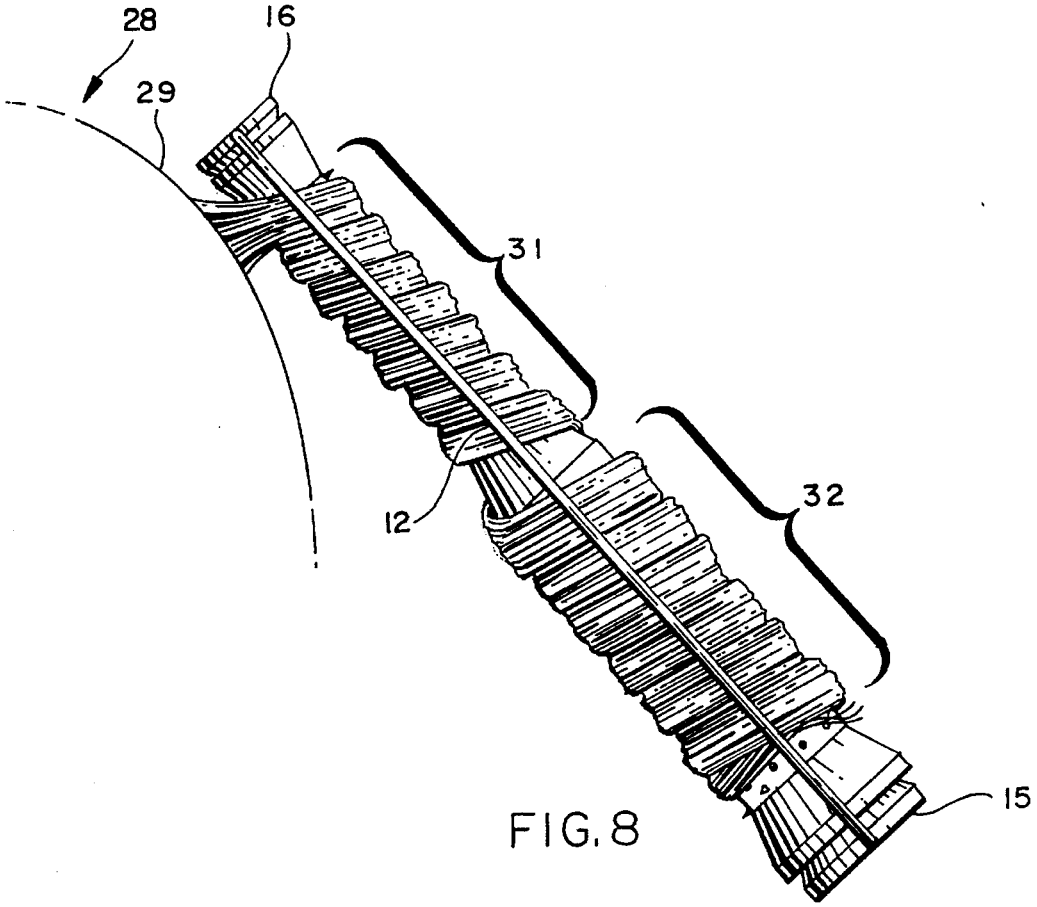
FIG. 8 is a partially diagrammatic view of an entire strand of hair wrapped around the perm rod kit desirably ready for the application of a cold waving solution.
Figure 9:
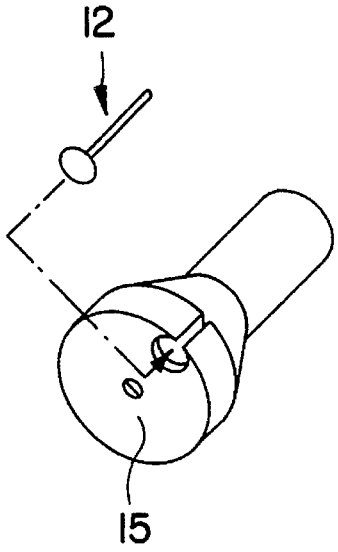
FIG. 9 shows how the elastomeric band is removably secured to the band plug.
Figure 10:
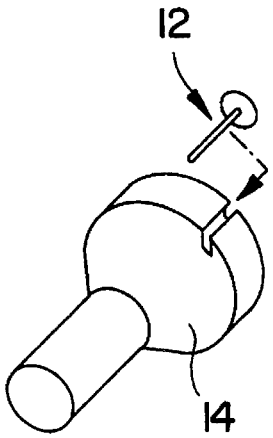
FIG. 10 shows how the elastomeric band is removably secured to the band cap.

In operation, reference should be made to FIGS. 7 and 8. There it will be seen that the method of utilizing the rod is illustrated firstly by identifying a head 28 having scalp 29 from which a strand of hair 30 can be grasped and secured by the beautician. In the instance as shown, there is a new hair portion of the strand 31 which is virgin and likely to be more straight than the old hair section 32 which exhibits the residual features of a previous permanent wave. Addressing a head such as exemplified, the beautician will want to begin a wrap as close to the scalp 29 as possible, and then wrap the new hair section 31 around the tight wrap section 22 of the perm rod kit 10. This is done diagrammatically as illustrated in FIG. 8 where it will be seen that the tight wrap section of new hair 31 covers the tight wrap portion of the perm rod kit 10, and the loose wrap portion covers the larger area and is identified as old hair 32. After the strand 30 has been wrapped around the perm rod 11, the band 12 is applied so that the strand 30 is secured to the perm rod 11 for further processing, most desirably chemically.

Best results have been achieved by using a cold wave solution manufactured by Matrix better known as the Matrix Exalante Exothermic. The processing time after the exotherm has been applied is normally a minimum of five minutes and a maximum of twenty-five minutes. With experience a beautician will be able to determine which length of time is most desirable for the particular strand of hair involved based upon its thickness, pre-existing treatment, chemical processing, and other conditions that most likely will exist in the hair.

Once the processing time is concluded, the strand remains on the perm rod 11 and a neutralizing solution is applied. A desirable neutralizing solution is also made by Matrix referred to as a neutralizing solution compatible with the Matrix Exalante Exothermic chemical treatment.

Once the hair has been neutralized, with longer hair particularly in the rear portion of the head, the lower few perm rod kits 10 are removed first to allow maximum comfort for customer, and then a rinse applied to the already neutralized hair. Subsequently the balance of the perm rod kits 10 are removed, and the hair rinsed and the permanent wave process is concluded.

While dimensions specifically are not a part of the invention, they do illustrate proportions, and in this instance do illustrate the optimized size for the loose and the tight wrap. In a commercially acceptable unit the overall length of the rod excluding the cap and plug approximates five and one-half inches. The section for the loose wrap is approximately two and three-quarters inches, and the section for the tight wrap is approximately two inches. The taper at the divider is approximately one-quarter of an inch at an angle of 45°, and the taper at the shoulders on the two ends is between one-eighth and one-quarter of an inch at 45°. The drain holes 20 may be the same diameter on the loose wrap and tight wrap section, or of a different diameter. Desirably, however, they are at least one thirty-second of an inch in diameter to one-eighth of an inch, and spaced on centers not exceeding one-half inch. Contemplated by the invention is a shorter version of the rod which is approximately four inches in length. Also, while the present perm rod kit 10 utilizes a straight cylindrical pair of body portions, within the contemplation of the invention those two body portions are of narrowing diameter in the mid-portion tapering outwardly to a larger diameter at both ends, and at the portion where the divider exists between the tight wrap and loose wrap sections. Also, the small spikes or dimples on the surface of the body are optionally employed where a stronger grip on the hair strand 30 is desired.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A perm rod kit comprising, in combination, a hollow perm rod body of substantially circular cross-section, one portion of the body having a diameter larger than the other portion for a loose wrap on the larger diameter portion and tight wrap on the smaller diameter portion, a band cap and a band plug conformed to penetrate opposite ends of the hollow body of the perm rod, an elastic band secured to the band cap and the band plug for securing a strand of hair applied to the perm rod body, and a divider section between the tight wrap and loose wrap sections of the body, which tight wrap and loose wrap sections extend laterally and coaxially in opposite directions from said divider section.

2. In the perm rod kit of claim 1 above, a plurality of drains provided longitudinally along the perm rod body to drain excess chemical which may be applied to a strand of hair.

3. A method of setting hair utilizing a permanent rod kit having an elongate perm rod body with a smaller tight wrap and larger loose wrap sections of differing diameters by an order of 20% or more converging at a divider portion of the rod body in which both sections are cylindrical and hollow comprising the steps of, grasping a strand of hair by its distal ends, wrapping said strand of hair on the loose wrap section of the perm rod body starting with the distal ends of said hair, thereafter rolling the perm rod body up the strand of hair such that the hair is wrapped first about the loose wrap section of said body and then about the tight wrap section of said body and stopping the rolling process only when said body is rolled up next to the ends of the hair and next to the scalp to which the hair is attached thereafter securing the hair as rolled to the perm rod body, and thereafter applying a chemical to the hair which will cause the same to permanently conform to the shape of the perm rod body.

4. In the method of claim 3 above, applying water to the hair before wrapping said hair about the perm rod body to cause the hair to wrap more tightly about the perm rod body.

5. In the method of claim 3 above, neutralizing the hair with a chemical compatible with the original applied chemical to the point where the treatment terminates, and thereafter optionally rinsing the hair and subsequently removing the perm rod kit.

6. In the method of claim 3 above, securing an elastic band over the strand of hair with the band anchored to the two ends of the rod.

7. A perm rod kit comprising, in combination, a hollow perm rod body of substantially circular cross-section, one portion of the body having a diameter larger than the other portion for a loose wrap on the larger portion and a tight wrap on the smaller portion, means for removably securing a band between one end and the other end of said rod body, and a divider section between the tight wrap and loose wrap sections of the body, said divider section tapering between the two diameters to thereby provide a transition for the tightness of the wrap at that portion, each of said body portions having drains to the central hollow interior.

8. A permanent rod kit for the permanent curling of hair, comprising, in combination:

a hollow permanent rod body of substantially circular cross-section, one portion of said rod body being a divider section, two portions of said rod body being sections for wrapping hair, where one hair wrapping section is larger in diameter than the other hair wrapping section, with the smaller diameter section being the tight wrap section and the larger diameter being the loose wrap section, and with the two hair wrapping sections extending coaxially in opposite directions from the divider section, and a means for securing a strand of hair to said rod body.

* * * * *